United States Patent [19]

Daniels et al.

[11] Patent Number: 4,559,760

[45] Date of Patent: Dec. 24, 1985

[54] UNIVERSAL CAPPING MACHINE

[75] Inventors: Ben G. Daniels, Elmhurst; Nicholas E. Hall; Daniel F. Naples, both of Tinley Park; Albert C. Schnell, Hickory Hills, all of Ill.

[73] Assignee: Continental White Cap, Inc., Northbrook, Ill.

[21] Appl. No.: 438,426

[22] Filed: Nov. 2, 1982

[51] Int. Cl.[4] ..... B67B 3/20; B65B 7/28

[52] U.S. Cl. ..... 53/314; 53/317; 53/331.5

[58] Field of Search ..... 53/331.5, 314, 315, 53/317, 201

[56] References Cited

U.S. PATENT DOCUMENTS

| | | | |
|---|---|---|---|
| 1,664,514 | 4/1928 | Kramer | 53/315 X |
| 2,433,549 | 12/1947 | Enkur et al. | 53/315 X |
| 2,658,654 | 11/1953 | Schweizer | 53/314 X |
| 3,012,388 | 12/1961 | Stover | 53/315 |
| 3,274,748 | 9/1966 | Roberts et al. | 53/315 X |
| 3,438,174 | 4/1969 | Foss et al. | 53/314 X |
| 3,849,973 | 11/1974 | Zetterberg | 53/331.5 |
| 3,905,177 | 9/1975 | Herzog | 53/331.5 X |
| 4,279,115 | 7/1981 | Roberts et al. | 53/315 X |

*Primary Examiner*—Horace M. Culver

*Attorney, Agent, or Firm*—Charles E. Brown

[57] ABSTRACT

This relates to a capper for applying closures to containers. In a packer's plant there is frequently a necessity to modify a capper so as to apply closures to containers of different diameters and different heights with the closures also being different in diameters, thicknesses, etc. In the past, the cappers have been provided with change parts and are in a certain degree adjustable so that a capper can be modified to accept a range of container diameters and heights and closure sizes. However, shut-down time has continued to be an important factor. Further, final adjustment of the capper after modification has been a problem. There has been provided a universal capper which is provided with height and width adjustments for both containers and closures and all of these adjustments may be made while the machine is operating so as to obtain minute adjustments. The changeover time is no longer a factor with the universal capper. This abstract forms no part of the specification of this application and is not to be construed as limiting the claims of the application.

4 Claims, 17 Drawing Figures

UNIVERSAL CAPPING MACHINE

This invention relates in general to a sealing or capping machine which will apply closures of various materials to filled containers. The filled containers will move through the machine at a constant speed and various sealing functions between closure and container will happen beginning with a cap pick-up station where closure and container will be joined in a non-indexed manner. Cap and container will then proceed through a cap applying station and a cap sealing area.

Cappers or sealers of the above-identified type are well known. However, it is to be understood that in the past, while there have been certain adjustments which would permit a single machine to apply and sealingly secure closures to containers wherein the containers and closures are of a variety of sizes, nearly all machines have required a replacement of parts. Further, most of the adjustments provided for in the past have been restricted to ones which must be effected while the machine is shut down, thereby eliminating any final adjustment of the machine for a new setup while the machine is running.

In accordance with this invention there has been provided a universal capper or sealer wherein all adjustments of the unit may be effected while the unit is in operation.

Most specifically, in accordance with this invention there is provided a single drive motor for driving the mechanical elements of the container movement through the unit as well as the closure turning mechanism, whereby there is a complete coordination established between these various components.

There has also been provided a vertical adjustment for the container retaining belts which may be actuated while the unit is operating so as most efficiently to position the container retaining belts relative to a container in accordance with the height of the container and the shape thereof requiring specific advantageous locations of the container retaining belts.

There has also been provided a simple back-up system for the container opposing runs of the container retaining belts whereby the container opposing runs may be transversely adjusted while the machine is running to effect the gripping of a container with the desired pressure.

Another feature of the invention is to provide for a vertical adjustment of the capper head wherein the capper or sealer may be adjusted for receiving containers of different heights while the machine is operating.

Other features include the adjustment of the cap applying chute for closures or caps of different sizes and the adjustment of the application of pressure by cap rotating belts which may be effected while the machine is operating.

There is also provided means for adjusting the cap supply chute, the cap applying heads and the cap rotating belts relative to the capper head, all while the machine is operating.

Further, there is provided a simple mounting of final guide chute elements which are not required when the cap is of the press-on type whereby these final guide chute elements may be readily rotated to out-of-the-way positions.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
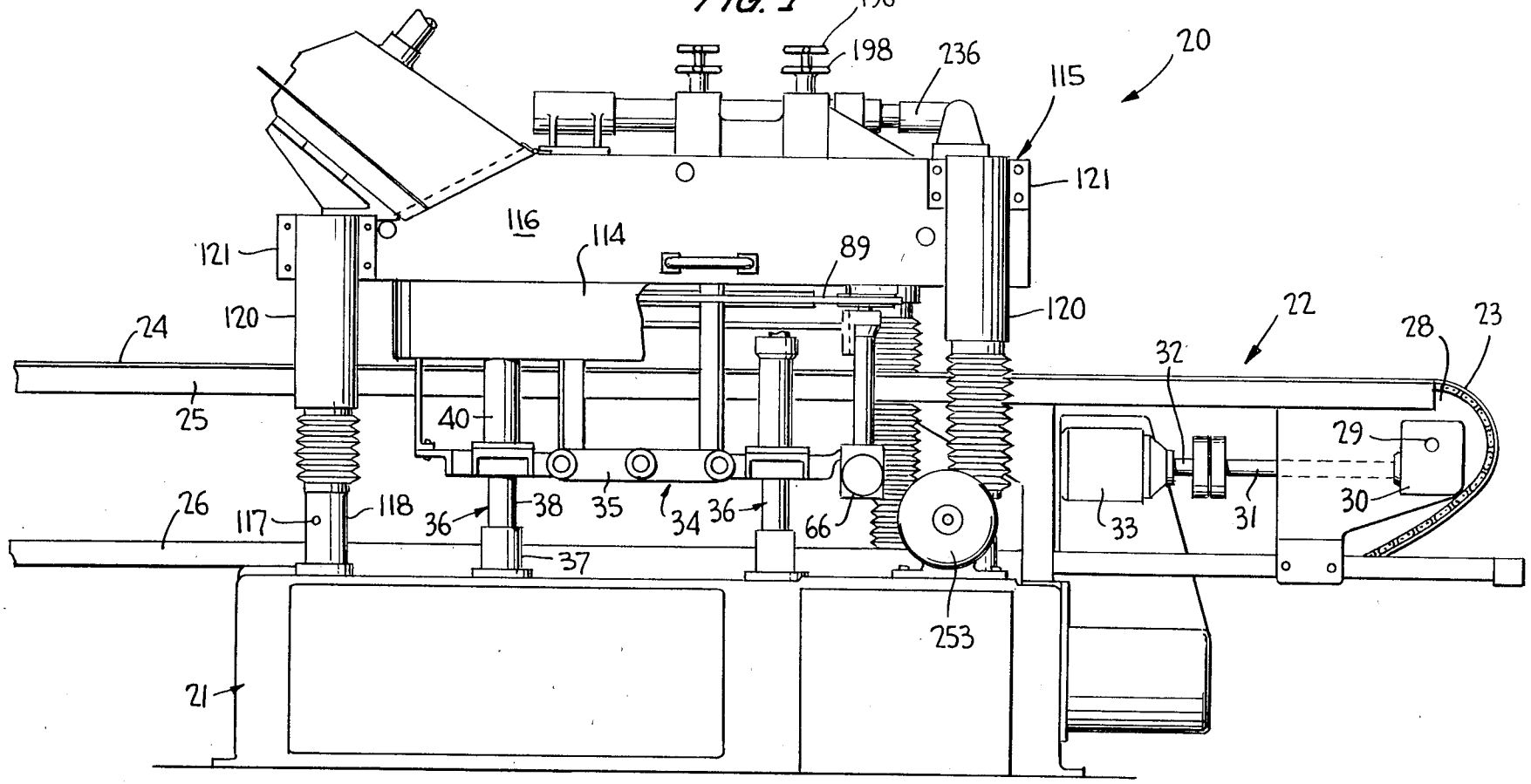
FIG. 1 is a side elevation of the universal capper as viewed from the drive side thereof.
Figures 2, 4:
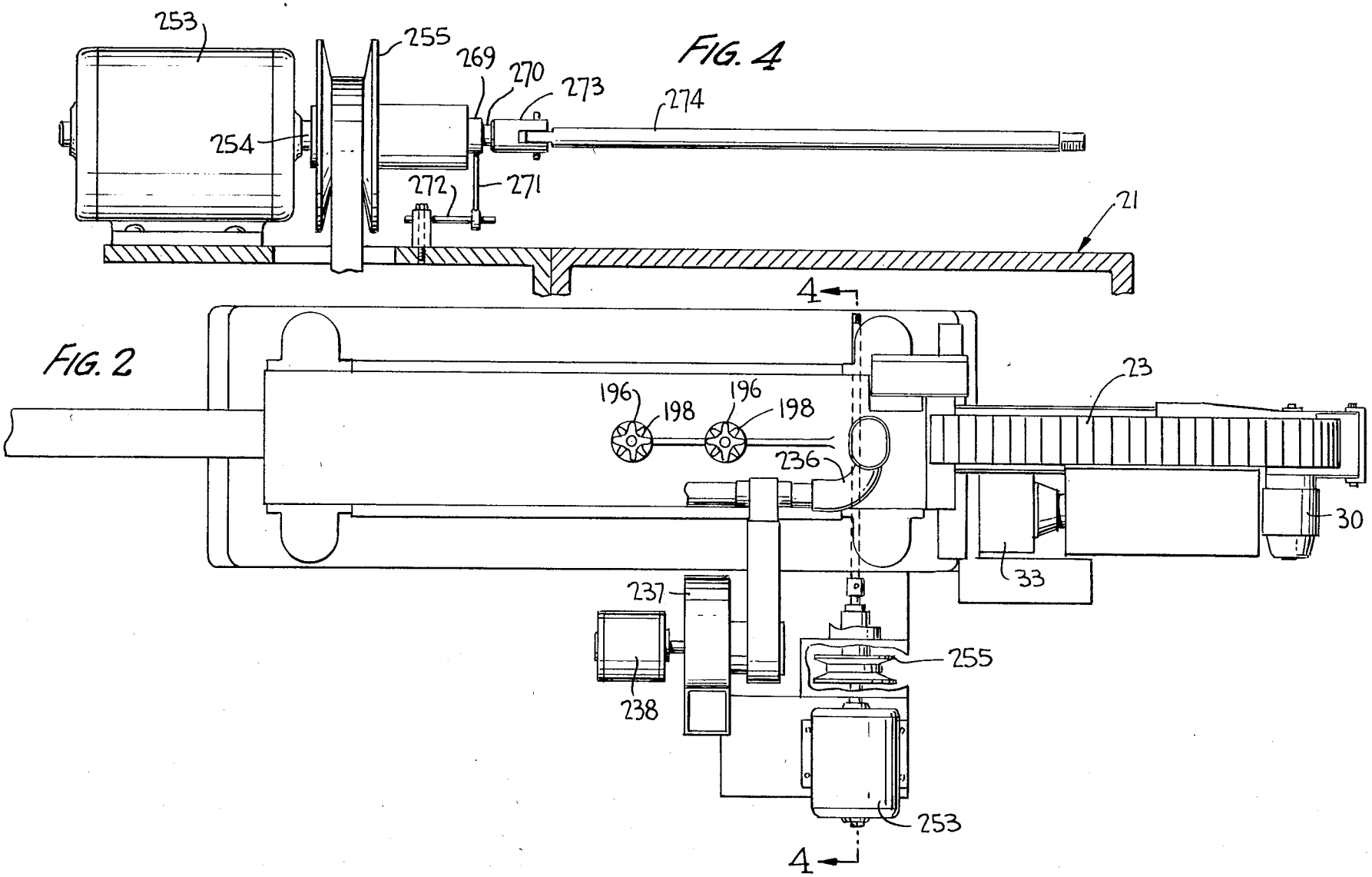
FIG. 2 is a plan view of the universal capper.
FIG. 4 is an enlarged fragmentary transverse vertical sectional view taken generally along the line 4—4 of FIG. 1, showing the manner in which a speed adjustment of the machine may be effected while the machine is operating.
Figure 3:
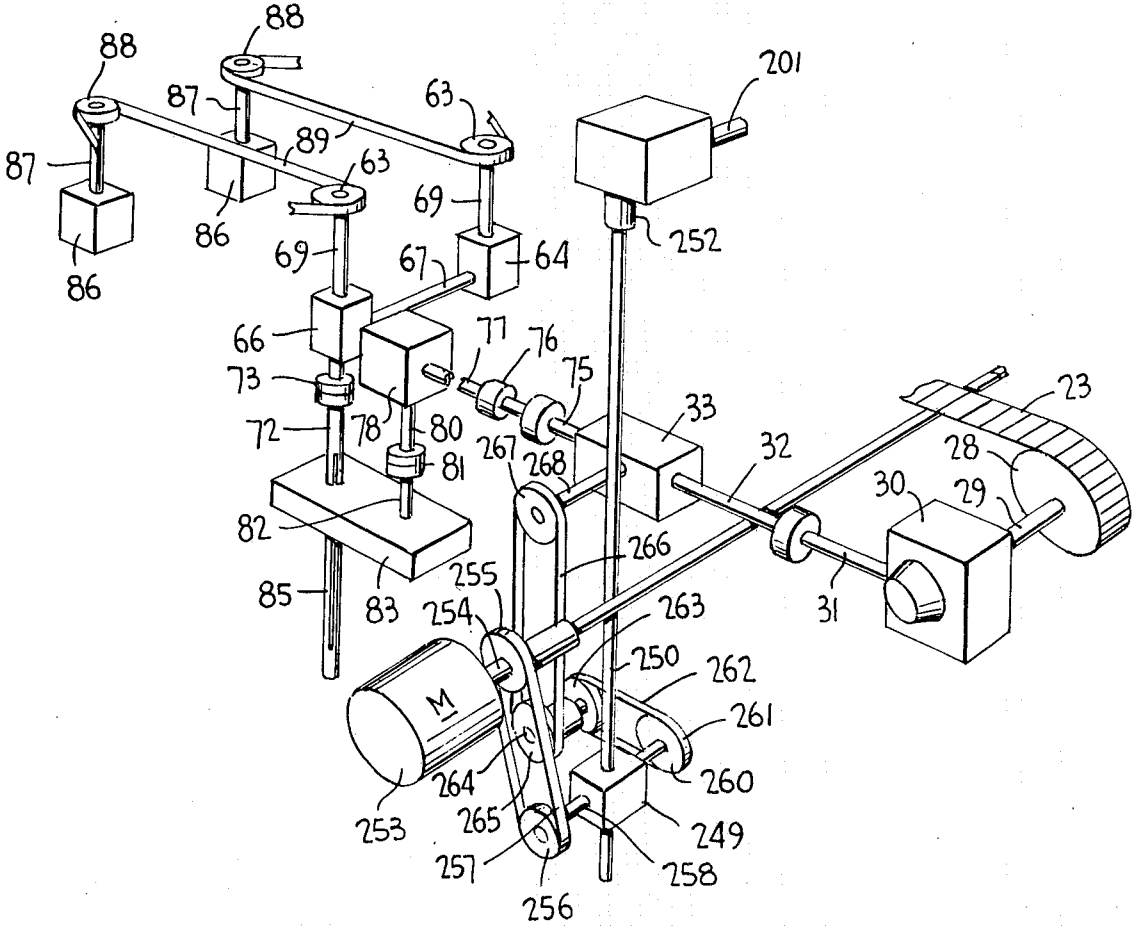
FIG. 3 is a schematic perspective view showing the drive elements for the various components of the universal capper.

Referring now to the drawings in detail, it will be seen that there is illustrated in FIGS. 1 and 2 the overall details of the universal capper or sealer which is the subject of this invention, the capper being generally identified by the numeral 20. The capper 20 includes a rigid base 21 which supports all elements of the capper. There is carried by the base 21 and endless container conveyor 22 which is mounted in the customary manner and is of the customary metal link conveyor belt type with the belt per se being identified by the numeral 23. The belt 23 has a top container supporting run 24 which is supported in a conventional manner by a support member 25. A return run of the belt 23 is located within a trough 26.

With particular reference to FIG. 1, it will be seen that the conveyor belt 23 is carried by a drive sprocket 28. The upper end of the endless conveyor 22 includes an idler sprocket arrangement, not shown.

The drive sprocket 28 is carried by a shaft 29 of a right angle gear head 30 which has an input shaft 31 connected to a takeoff shaft 32 of a multiple takeoff drive unit 33. The manner in which the drive unit 33 is driven will be described in more detail hereinafter.

In order that the containers which are being closed may be gripped to prevent rotation or movement during the application of a closure and at the same time be fed at random intervals to the capper, there is provided a container retaining belt assembly which is generally identified by the numeral 34, the position of which is illustrated in FIG. 1 and the details of which are more specifically illustrated in FIGS. 9–12. The assembly 34 includes a support unit 35 which is carried by four column-type supports 36, there being two supports 36 on each side of the capper 20.

Each of the supports 36 includes a base member 37 having extending upwardly therefrom a tubular column 38. The support unit 35 carries a tubular sleeve 40 which is telescoped over the column 38 and is slidable therewith. The sleeve 40 carries a fixed nut (not shown) while the column 38 has rotatably journalled therein a threaded shaft 41 which is engaged with the nut. Thus, when the shaft 41 is rotated, depending upon the direction of rotation, the support 35 moves up or down.

Figure 16:
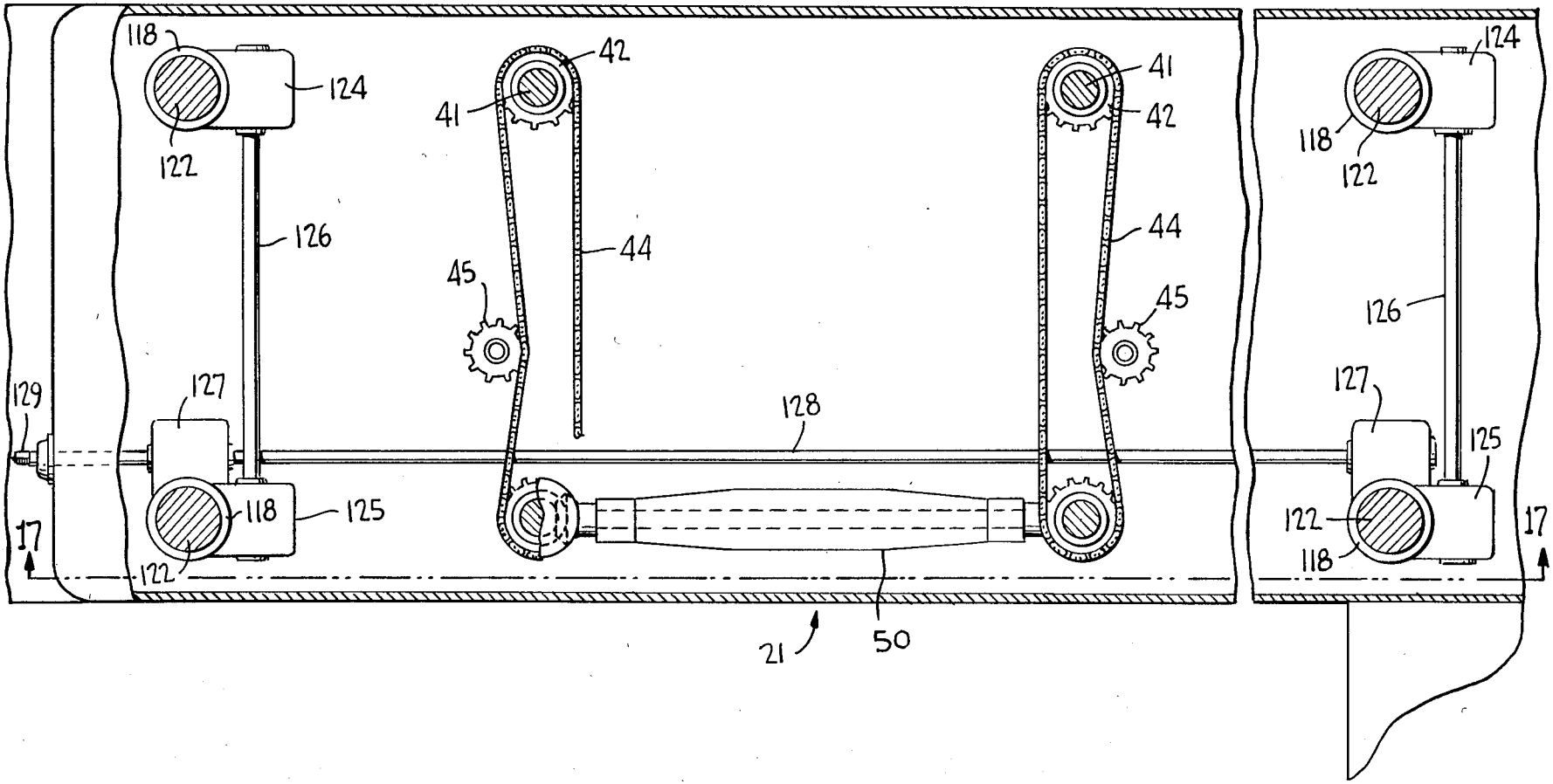
FIG. 16 is a schematic horizontal sectional view taken through the machine base, and shows the manner in which the support for the container retaining belts and the capper head may be separately vertically adjusted during operation of the machine.
Figure 17:
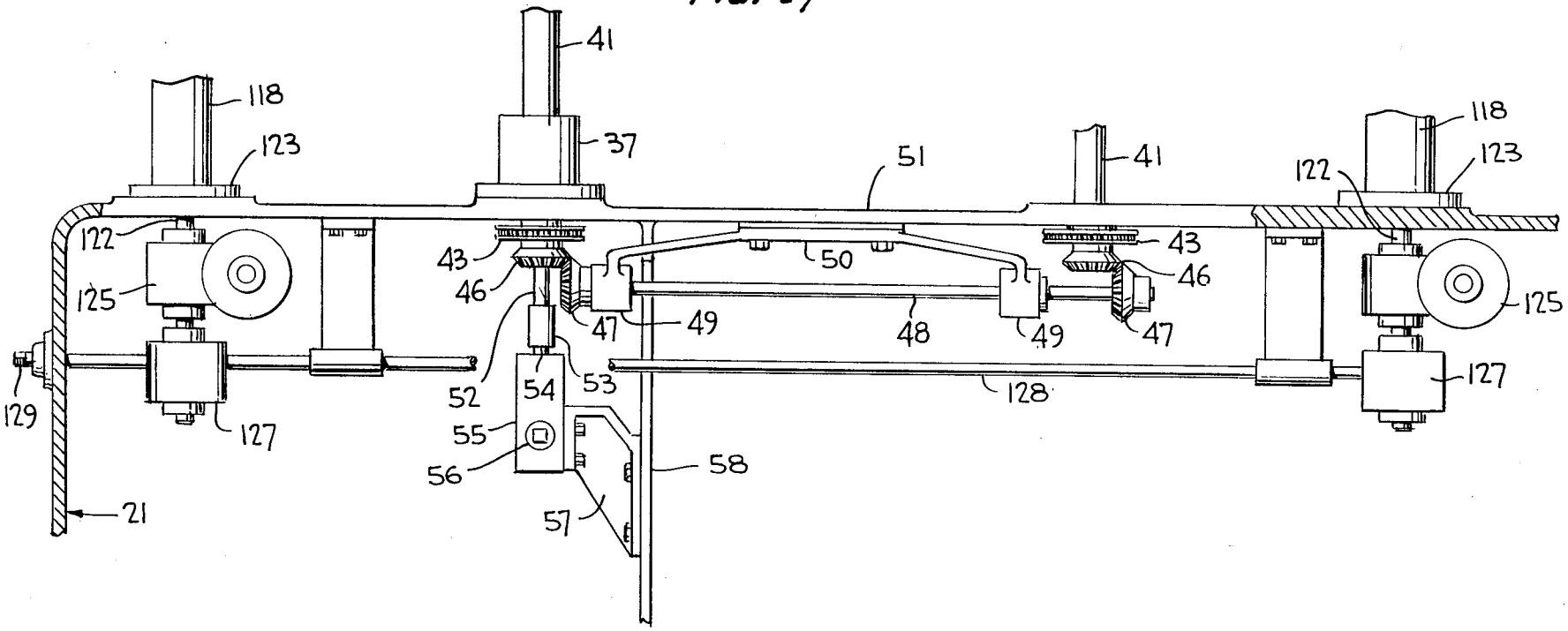
FIG. 17 is a fragmentary vertical sectional view taken generally along the line 17—17 of FIG. 16, and shows more specifically the details of the adjustments of FIG. 16.

With reference to FIGS. 16 and 17, it will be seen that the threaded shafts 41 on the side of the machine illustrated in FIG. 1 will have secured to the lower ends thereof sprockets 42 for effecting rotation of the threaded shafts. On the other hand, the shafts 41 on the side of the machine opposite from that illustrated in FIG. 1 will carry drive sprockets 43. Each sprocket 43 is connected to a transversely opposite sprocket 42 by a drive chain 44 having a slack takeup sprocket 45, as is clearly shown in FIG. 16;

The two shafts 41 carrying the sprockets 43 have at the lower ends thereof bevel gears 46 which mesh with bevel gears 47 carried by a common horizontal shaft 48 and rotatably journalled in bearing units 49 carried by a support 50 secured to an underside of a top wall 51 of the base 21.

With particular reference to FIG. 17, it will be seen that the left hand shaft 41 has a depending extension 52 which is connected by means of a coupling sleeve 53 to an output shaft 54 of a gear box 55 having an input shaft 56 which is opened through the adjacent side wall of the base 21. The gear box 55 is mounted on a bracket 57 carried by an internal supporting flange 58 of the base 21.

It will thus be apparent that by rotating the input shaft 56, all of the shafts 41 may be rotated in unison to elevate the support 35 evenly, thus to raise and lower the container retaining belt assembly 34 in accordance with the requirements for the particular container which is being supplied with a closure cap.

Figure 9:
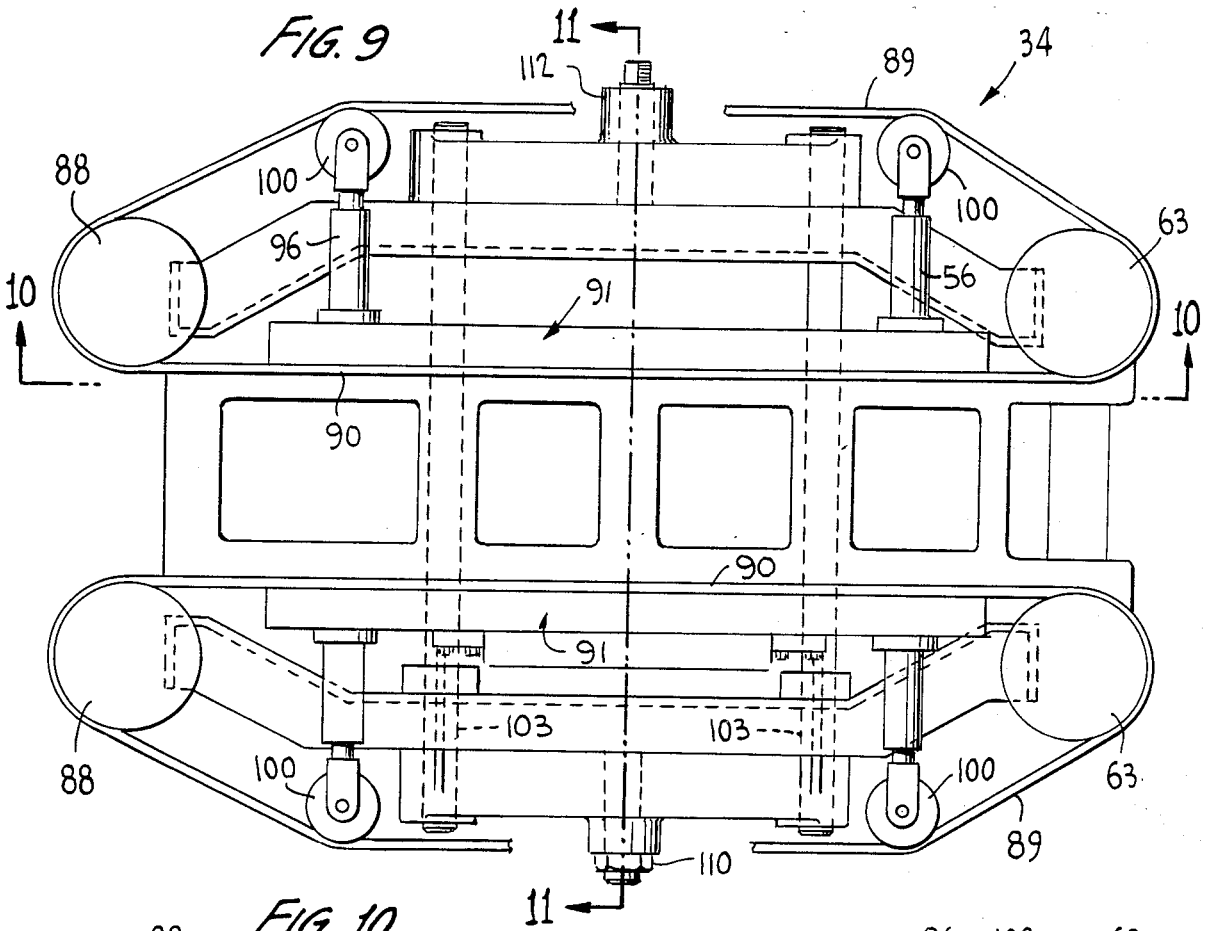
FIG. 9 is a fragmentary plan view showing the general details of the container retaining belts and the adjustment therefor.
Figure 10:
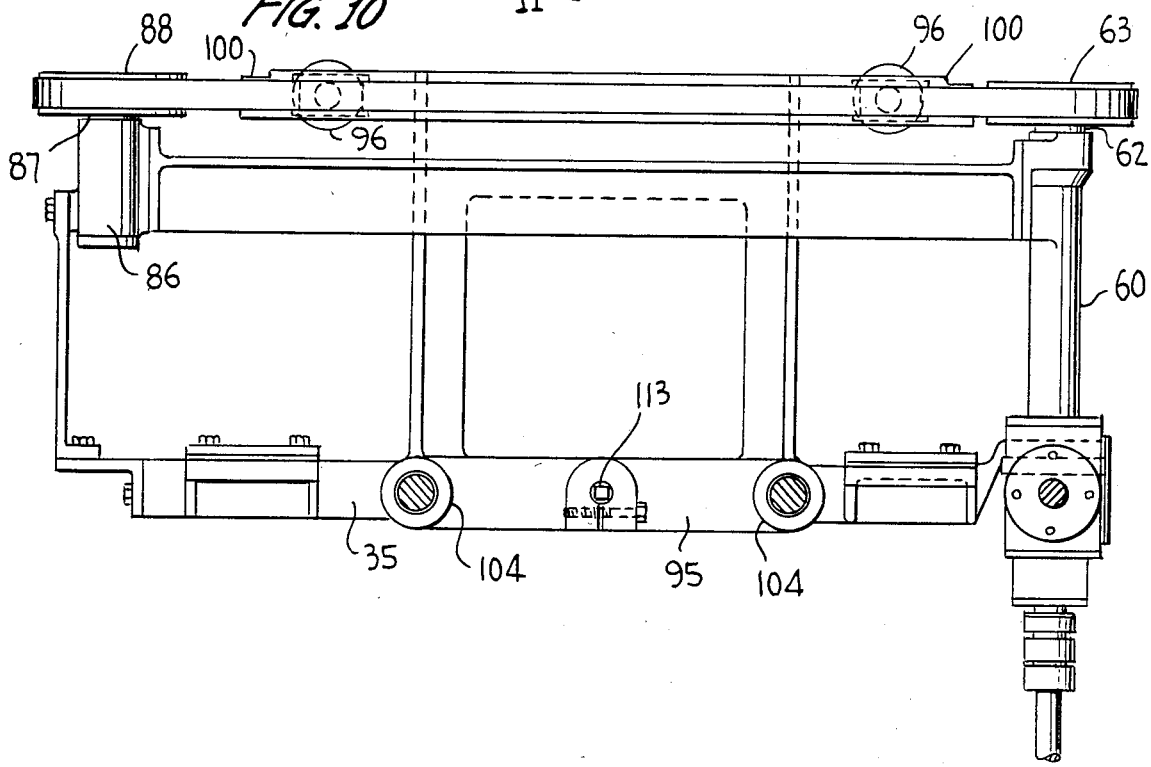
FIG. 10 is an enlarged fragmentary vertical sectional view taken generally along the line 10—10 of FIG. 9, and shows more specifically the details of the adjustment of the container opposing runs of the container retaining belts.

Referring now to FIGS. 9–12, with particular reference to FIG. 10, it will be seen that the support 35 carries at one end thereof a pair of transversely spaced, vertically extending, tubular housings 60, 61. Each of the housings 60, 61 has rotatably journalled therein and extending vertically therefrom a drive shaft 62 which carries a drive pulley 63. The housing 61 has its lower end forming part of a right angle drive 64 which, in turn, is connected by means of a horizontal tubular housing 65 to a right angle drive box 66. A shaft 67 extends between the drive boxes or units 64, 66 within the housing 65 and has mounted on opposite ends thereof bevelled gears 68 which are meshed with bevelled gears 69 carried by the shafts 62.

The drive unit or box 66 differs from the drive unit 64 in that it carries an input shaft 70 which, in turn, carries a bevelled gear 71 which is meshed with the gear 68. The shaft 70 is coupled to a drive shaft 72 by means of a coupling 73.

At this time it is pointed out that the housing 65 is provided with mounting brackets 74 which are utilized to secure the housing and other components of the drive for the pulleys 63 to the support 35 for movement therewith.

Figure 14:
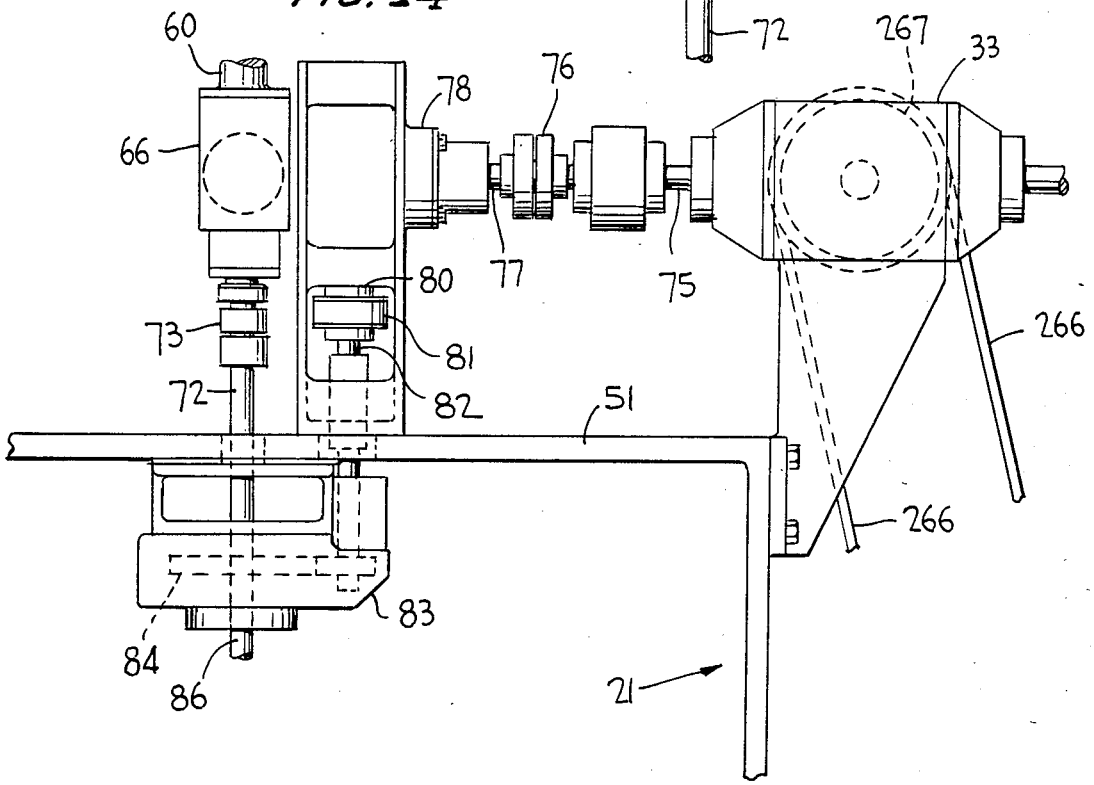
FIG. 14 is a fragmentary elevational view showing the manner in which the main drive for the container retaining belts from the drive motor is effected.

Referring now to FIG. 14, it will be seen that the multiple takeoff drive unit 33 includes a further drive shaft 75 which extends horizontally and which is coupled by means of a coupling 76 to an input shaft 77 of a right angle drive 78 which is fixedly mounted relative to the top wall 51 of the base 21. The right angle drive unit 78 has an output shaft 80 which is coupled by means of a coupling 81 to a vertical drive shaft 82 which extends into a gear box 83. The gear box 83 includes an output gear 84 with which the shaft 72 has a vertical sliding connection by means of an elongated drive key 85. Thus the drive for the container positioning unit 34 may be vertically adjusted relative to the base 21 even while the machine is operating.

Returning to FIGS. 9 and 10, it will be seen that the support 35 also carries a pair of bearing units 86 which, in turn, carry idler shafts 87 supporting idler pulleys 88.

At this time it is pointed out that while specific reference is made here to drive pulleys 63 and idler pulleys 88, it is to be understood that the container positioning belts 89 which are entrained over these pulleys preferably have drive lugs and would be identified as being of the timing belt type. The pulleys 63, 88 would also have cooperating drive lugs.

It is also pointed out here that the container engaging face of each belt 89 may have attached thereto or formed as part thereof a sponge-like face which is in the form of a plurality of ribs separated by circumferential grooves which are vertically spaced.

Figure 11:
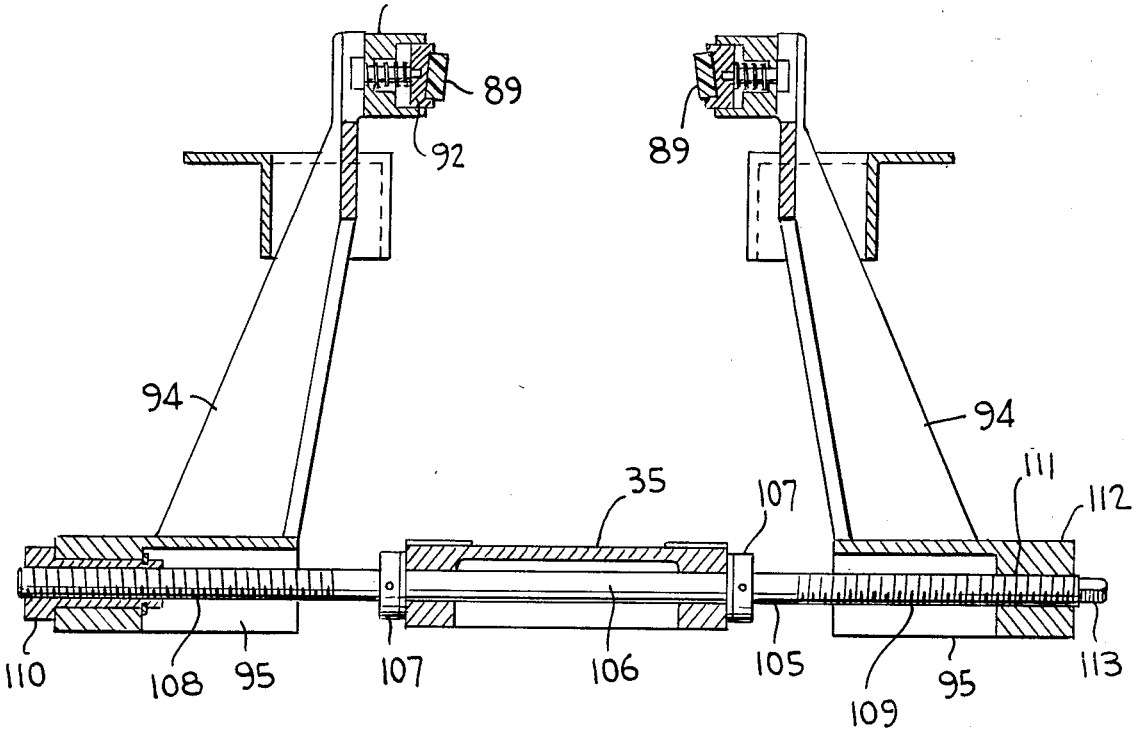
FIG. 11 is an enlarged fragmentary transverse vertical sectional view taken generally along the line 11—11 of FIG. 9, and shows further the details of the adjustment of the container opposing runs of the container retaining belts.
Figure 12:
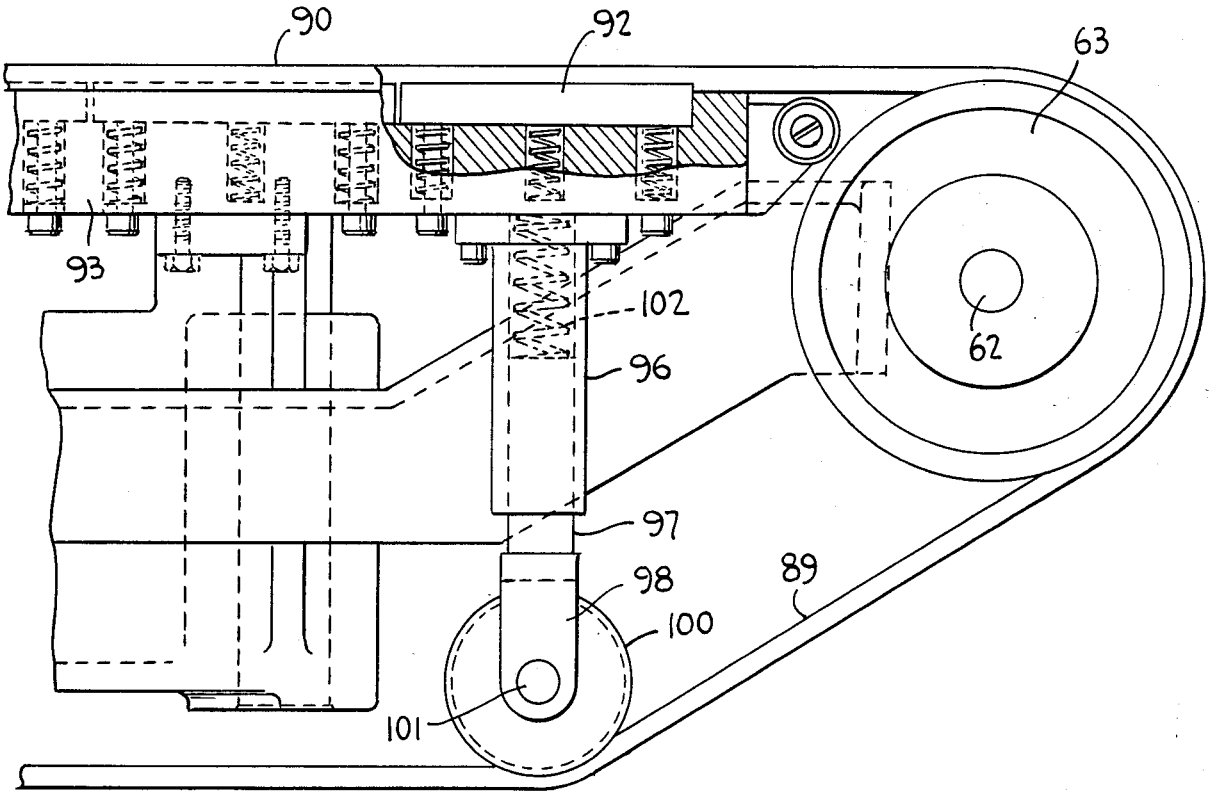
FIG. 12 is an enlarged plan view of one of the container retaining belts, and shows the specifics of the adjustment therefor.
Figure 13:
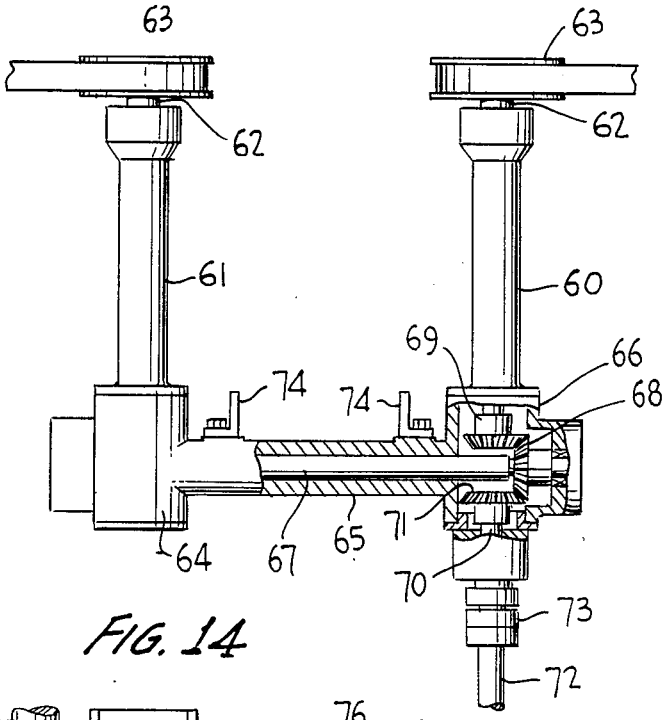
FIG. 13 is a fragmentary elevational view showing the manner in which the two container retaining belts are driven in unison.

It will be seen that in FIG. 9 opposed runs 90 of the belts 89 are illustrated in their widest spaced relation with these runs being backed up by backing units 91. Each backing unit 91 includes a spring loaded backing member or members 92 (FIGS. 11, 12). Each backing member 92 is carried by a housing 93 which extends between upper portions and are secured to upstanding brackets 94. There are at least two such brackets 94 for each belt 89 and these brackets are interconnected by a base portion 95. The base portions 95 are mounted for transverse adjustment in a manner to be described in detail hereinafter.

Referring particularly to FIG. 12, it will be seen that each housing 93 carries adjacent the ends thereof a rearwardly facing sleeve member 96 in which there is telescoped for guided movement into and out of the sleeve member a shaft 97 having a bifurcated end portion 98 in which there is rotatably journalled a slack takeup pulley 100 by way of a pin 101. A spring 102 in each of the sleeves urges the associated shaft 97 out of the sleeve. In this manner each of the belts 89 remains properly tensioned notwithstanding the fact that the run 90 thereof may be shifted relative to that position which would normally be maintained by the associated pulleys 63, 88.

As is clearly shown in FIGS. 9, 10 and 11, the bases 95 for the brackets 94 are mounted for movement toward and away from one another relative to the support 35. The support 35 carries two guide shafts 103 which extend to opposite sides thereof and which are received in bearing portions 104 of the bases 95. The bases 95 and thus the brackets 94 are thus fixed relative to the base 95 for vertical adjustment while being moved toward and away from one another for adjusting the runs 90 of the belts 89 in accordance with the diameters of the containers to be closed.

Adjustment of the positions of the bases 95 and the brackets 94 is effected by means of an adjusting screw or shaft 105 which has an unthreaded central portion 106 rotatably journalled within the base 35 and retained against axial shifting by means of collars 107. The end portions of the shaft 105 are threaded and identified by the numerals 108 and 109, one being a left hand thread and the other being a right hand thread. The threaded portion 108 is engaged within a nut 110 fixedly carried by the associated base 95 while the threaded portion 109 is threadedly engaged in an internally threaded bore 111 formed in a boss 112 of the other base 95. The threaded portion 109 terminates in a drive end 113 which may be square in cross section or otherwise configured for engagement by a drive tool.

It is to be understood that the container positioning belts 89 may be positioned at the desired height above the top run of the container conveyor 22 and adjusted transversely of the container conveyor for engaging the specific container which is being closed at both the desired height and with the desired firmness or tightness. As is clearly shown in FIG. 1, all of the moving parts of the container positioning unit 34 are suitably encased including by means of a housing 114 which is removably secured to the support 35.

The upper part of the capper 20 is in the form of a capper head generally identified by the numeral 115. The capper head 115 is generally in the form of an elongated housing 116 which is open at its bottom facing the top run of the endless conveyor 22. The housing 116 is fixedly mounted relative to the base 21, except for vertical adjustment, by means of four column-type supports 117 which are arranged in pairs at opposite sides of the endless conveyor 22. Each support 117 includes a lower sleeve member 118 over which there is telescoped in guided relation an upper sleeve member 120 which is secured to the housing 116 in fixed relation by a mounting bracket 121. Each sleeve 118 has rotatably journalled therein a threaded shaft 122 (FIG. 17) with which is engaged a nut (not shown) carried by an associated sleeve 120. Each of the sleeves 118 is secured to the top wall 51 of the base 21 by means of a mounting flange 123 and each of the shafts 122 on the side of the machine illustrated in FIG. 1 is driven through a right angle drive unit 124 (FIG. 16). Each of the shafts 122 on the opposite side of the machine from that shown in FIG. 1 is driven by a right angle drive unit 125 which is also suitably mounted with respect to the base 21. Each right angle drive unit 125 is coupled to a transversely opposite one of the drive units 124 by a shaft 126 and has a further right angle drive component 127 which drive components 127 are interconnected by a longitudinal shaft 128 having a drive end 129 projecting from an end of the base 21. Thus when the drive end 129 is rotated to drive the shaft 128, all of the shafts 122 are rotated in unison so as to effect the vertical adjustment of the capper head housing 116.

It is to be understood that the capper unit 115 must be vertically adjusted in accordance with the height of containers which are to be closed. It is understood that this adjustment may be minute in its final stage, and therefore it is highly beneficial that the height of the capper head 115 may be adjusted during the operation of the capper 20.

The capper head 115 includes a cap or lid chute assembly 130 which receives caps or lids from a hopper 131 which is also suitably mounted on the housing 116. The hopper 131 and the cap or lid components delivery components are conventional and need not be described in detail here.

Downstream of the chute assembly 130 are cap or lid positioning units 132 and 132 which make certain that the caps or lids are squarely positioned on the neck finish of a container to be closed. Next to the positioning unit 133 is a position detector 134 which determines whether the applied closure is properly positioned. Finally, there is a closure rotating unit 135.

Figure 8:
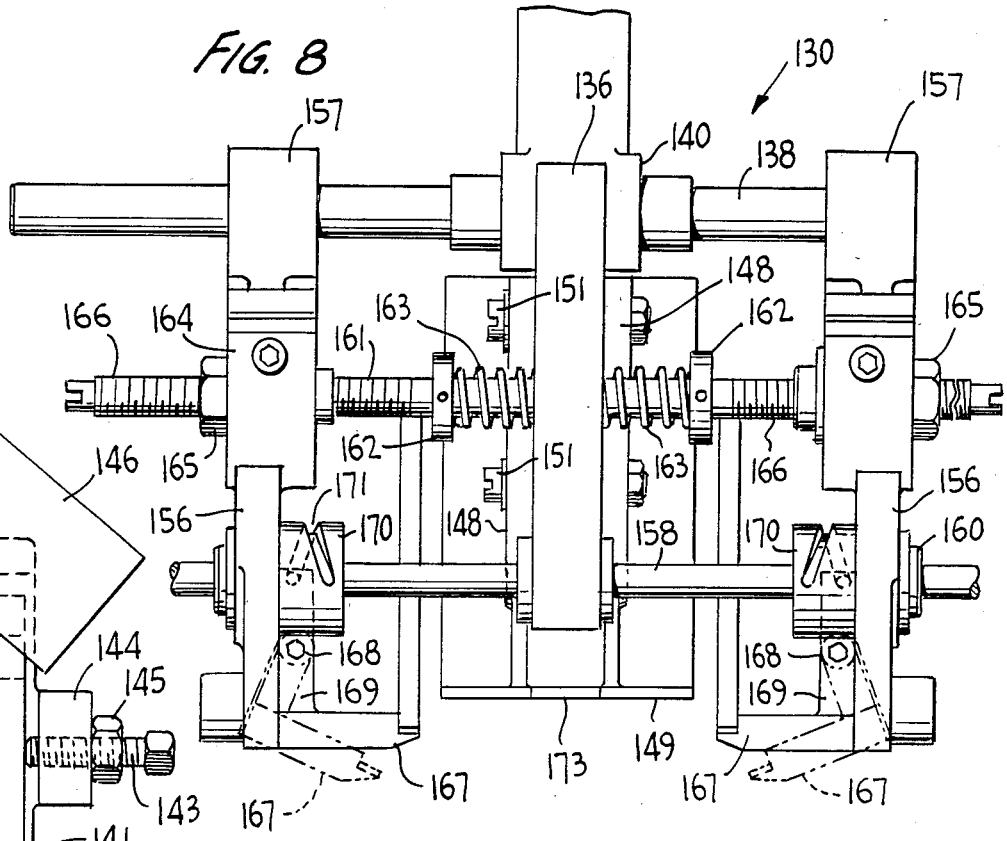
FIG. 8 is an end view taken generally along the line 8—8 of FIG. 7 of the guide chute, showing general details of adjustment therefor.

Referring now to FIGS. 8 and 9, it will be seen that the chute assembly 130 includes a central support 136 which is supported from the housing 116 by means of a bracket 137 carrying at its lower end a pivot pin 138. The support 136 has a sleeve or bushing portion 140 which is rotatably journalled on the pin 138 and which has a positioning arm 141 extending upwardly therefrom. The positioning arm 141 is urged in a clockwise direction by a compression spring 142 against an adjustable stop screw 143 which is threaded in a bar portion 144 of the bracket and is maintained in adjusted position by a lock nut 145. It thus will be seen that the support 136 is positioned by the adjustable stop screw 143, but is free to swing upwardly in a counterclockwise direction in the case of being struck by an immovable object such as a too high container.

The bracket 137 has secured to opposite sides thereof mounting blocks 146 which carry mounting pins 147 which are releasably received in like mounting blocks (not shown) carried by the housing 116 for ease of removal of the guide chute assembly 130 and replacement thereof with a similar but different unit depending upon the specific nature of the closure.

The support 136 has on opposite sides thereof plates 148 which carry a closure hold-down shoe 149. The plates 148 are adjustable relative to the support 136 and each plate has an elongated slot 150 through which a belt 151 passes. Further, the plates 148 have elongated slots 152 in which eccentrics 153 are engaged. Each eccentric is carried by a rotatable shaft 154 which is journalled in the support 136.

Figure 7:
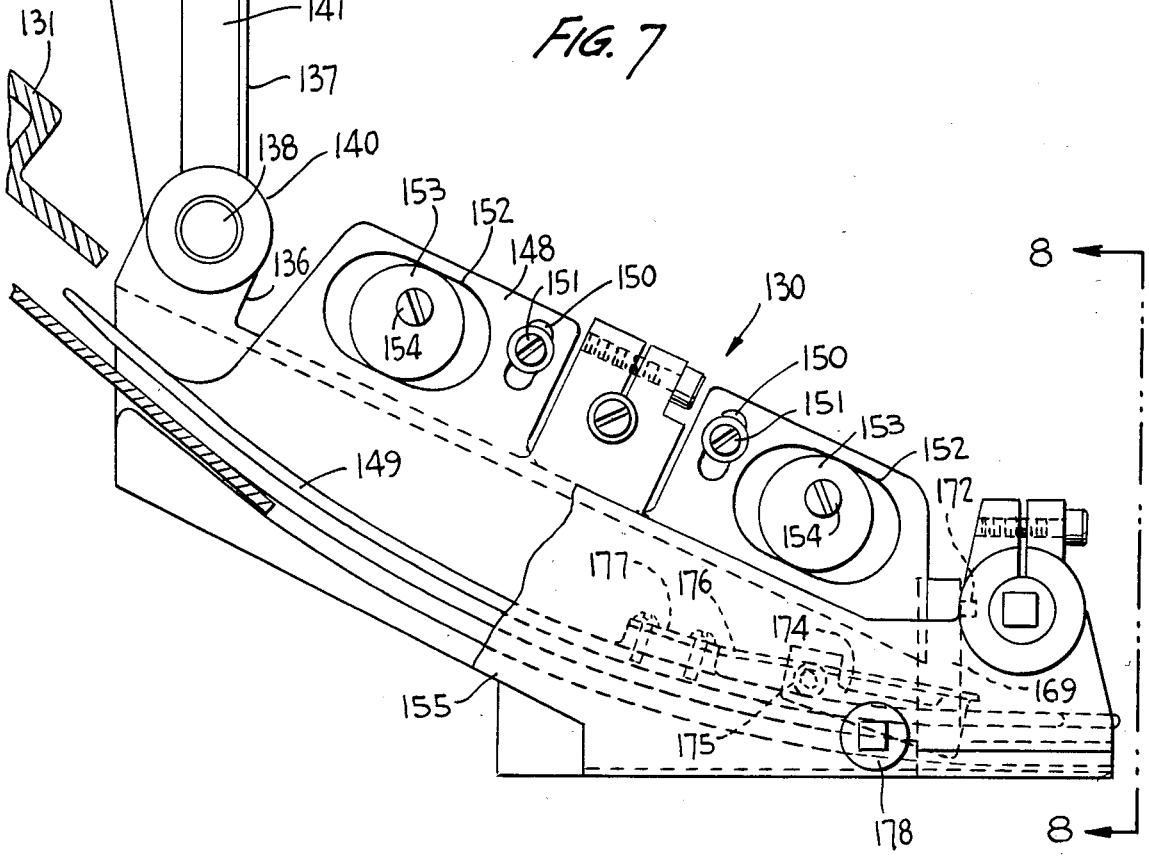
FIG. 7 is an enlarged fragmentary side elevational view showing the specific mounting of the guide chute for directing caps to the containers.

The support 136 also carries a pair of outermost cap support flanges 155 which have generally the same curvature as the hold-down plate or shoe 149, as is best shown in FIG. 7. The flanges 155 are carried by plates 156. Each plate 156 has a rear portion 157 with the shaft 138 being fixed to one of the hub portions 157 and being slidable with respect to the other of the hub portions 157. The shaft 138 is also slidable through the bushing 140 so that transverse adjustment of the support flanges 155 is possible.

The front end of each of the plates 156 is carried by a transverse shaft 158 which is rotatably journalled in the front part of the support 136 and is slidably engaged in bushings 160 in the front portions of the plates 156. A central portion of the support 136 carries in fixed relation a rotatable adjusting screw 161 which is located by means of collars 162 and springs 163. Each plate 156 has a central clamp portion 164 in which there is clamped a nut member 165. Each nut member 165 is of a different thread and the shaft 161 has externally threaded end portions 166 which are threaded in the respective nuts 165. By rotating the shaft 161, the plates 156 and thus the support flanges 155 are selectively moved together or apart to accommodate closures of different diameters. By vertically adjusting the hold-down plate 149 closures of different heights or thickness may be accommodated.

The flanges 155 are supplemented at the forward end of the lower chute assembly 130 by pivotally mounted cap supporting flanges 167. The flanges 167 are pivotally mounted on generally longitudinally extending pins 168 by means of upwardly extending bracket portions 169.

Carried by the shaft 158 immediately adjacent each plate 156 is a cam member 170 having a cam groove 171 therein which has received therein a cam pin 172 carried by each bracket portion 169. By rotating the shaft 158, the support flanges 167 may be tilted to out-of-the-way positions as shown in FIG. 8 when the closures are of the press-on type in that this additional support for the closures is utilized with this type of closure.

The forward end of the closure hold-down shoe 149 is bifurcated as at 173 and has positioned therein a spring loaded pressure applying finger 174 which is pivotally mounted on a transverse support pin 175 and is resiliently urged downwardly by a leaf spring 176 having one end fixedly anchored as at 177. A rotatable shaft 178 extends between the plates 156 and carries an eccentric for limiting the downward pivoting of the finger 174, the eccentric not being shown.

Figures 5, 6:
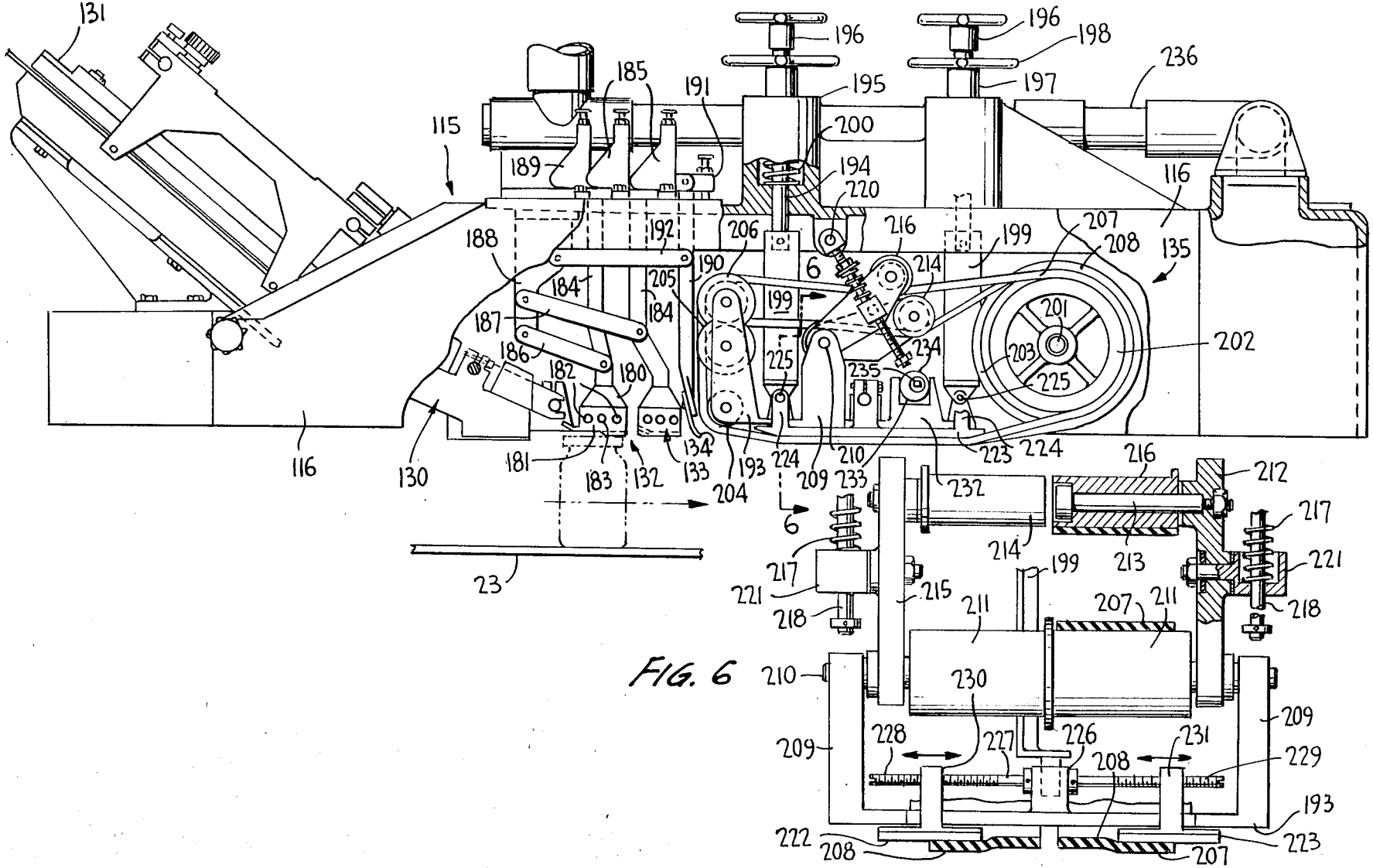
FIG. 5 is an enlarged fragmentary side elevational view of the capper head with parts broken away and shown in section, illustrating the details of the cap applying, positioning and rotating means.
FIG. 6 is an enlarged fragmentary sectional view taken generally along the line 6—6 of FIG. 5, and shows the manner in which the pressure applying shoes for the cap rotating belts may be adjusted.

It is to be understood that as a container moves beneath the chute assembly 130 on the conveyor belt 23, it will pick up a lowermost closure, as is generally shown in FIG. 5. The container and closure assembly will then pass beneath a first closure positioner 132 with the closure being squared onto the container and partially rotated in the event the closure has threads or lugs and the closure is to be applied by rotation. The positioner unit 132 has a central support 180 and a pair of positioning plates 181 are mounted on opposite sides thereof on pins 182. A double threaded ended adjusting screw 183 is rotatably journalled in the support 180 and has end portions of opposite hand threaded in the positioning plates 181 to adjust the transverse relationship of the positioning plates.

The second closure positioning unit 133 is of a like construction to that of the closure positioning unit 132. The supports of the positioning units 132, 133 each includes an upstanding support rod 184 which is connected at its upper end to a spring loaded vertical adjustment unit 185 so as to adjust the height of each positioning unit. The positioning units 132, 133 are also longitudinally retained against movement by links 186, 187, which are pivotally connected between the supports 184 and a mounting arm 188. It is to be understood that, if desired, quick release pins may be utilized.

The mounting arm 188 is also positioned by means of a spring loaded vertically adjustable device 189.

The closure position detector 134 is carried by a vertical arm 190 having its upper end pivotally connected to a spring loaded switch arrangement 191. The closure position detector 134 is longitudinally positioned by means of a link 192 which is also connected to the mounting arm 188. It is to be understood that when a closure is not properly positioned on a container and the switch 191 is actuated, means will be provided to eliminate the improperly closed container. The means may vary and may include an automatic kick-out down the conveyor 23 for the improperly closed container. However, such kickout is not part of this invention.

As previously described, the closure is only loosely applied to the container and must now be further rotated so as to be tightened into sealed relation. The closure rotating unit 135 is provided for this purpose.

The closure rotating unit 135 includes a support 193 which is suspended from the housing 116 by means of vertically adjustable shafts 194 mounted within tubular projections 195 and including an adjusting nut (not shown) carried by an adjusting hand wheel 196 and a locking nut 197 carried by an adjusting hand wheel 198. The shafts 194 are spring loaded against the adjustments by means of springs 200 and are connected to the support 193 by brackets 199.

There is a drive shaft 201, to be described in more detail hereinafter, on which are mounted drive pulleys 202 and 203 of different diameters. Remote from the drive pulleys 202, 203 are lower idler pulleys 204 for the two belts and separately mounted upper idler pulleys 205 and 206 associated with belts 207 and 208 entrained over the pulleys 202 and 203, respectively.

The support 193 also includes brackets 209 which carry a pivot shaft 210 for idler pulleys 211 of which, in the illustrated form of the invention, only one is utilized and that one is engaged by the belt 207. The shaft 210 also carries an idler arm 212 having a shaft 213 carrying an idler pulley 214 under which the belt 208 is engaged. A second idler arm 215 is pivotally mounted on the shaft 210 and carries an idler pulley 216 under which the belt 208 passes. Each of the idler arms 212, 215 is urged into engagement with its respective belt 207, 208 by means of a spring 217 carried by a rod 218 pivotally mounted on the housing 116 as at 220 in FIG. 5 and passing through a combined slide and force applying block 221.

At this time it is pointed out that the idler pulley 214 is illustrated in its free upstanding position and in operation would be much lowered as shown in FIG. 5, properly to engage the belt 207 as does the pulley 216 engage the belt 208.

At this time it is pointed out that the support 193 carries a pair of depending pressure shoes 222, 223 which have their remote ends supported for transverse adjustable movement by a pair of upstanding brackets 224, which are mounted on pins or rods 225 which also connect the support 193 to the hangers 199. As is best shown in FIG. 6, the support 193 has an upstanding central lug 226 which has rotatably journalled therein an adjusting screw 227 which is provided with threaded end portions 228, 229 of different hand. The threaded end portion 228 is threadedly engaged in an upstanding centrally located lug carried by the shoe 222 while the threaded portion 229 is threadedly engaged in a like lug 231 of the shoe 207.

It will be apparent from FIG. 6 that although the belts 207, 208 are not transversely adjustable, by having the shoes 222, 223 transversely adjustable the points of application of pressure on the closures may be varied thereby rendering the same adjustable for closures of different diameters.

Referring once again to FIG. 5, it will be seen that the central part of the support 193 has an upstanding lug 232 defining a slot 233 in which there is positioned an eccentric 234 carried by a shaft 235 which is rotatably journalled relative to the housing 116. It is to be understood that the support 193 is also pivotally mounted on the rods 225 and may thereby be longitudinally adjusted.

At this time it is pointed out that the rotational speed of the drive shaft 201 is relative to the linear speed of the endless conveyor belt 23 and the diameters of the pulleys 202 and 203 are such that the belt 207 has a linear speed less than that of the conveyor belt 23, and the belt 208 has a linear speed greater than that of the conveyor belt 23 with the net result being that the moving closure engaging the belt 203 is urged to the left, as viewed in FIG. 5, and thus rotated in a clockwise direction while the belt 208 attempts to move the closure relative to the container to the right, as viewed in FIG. 5, and thus also in a clockwise direction tightly to engage the lugs or threads of the closure with the neck finish of the container.

It is also pointed out here that the housing 116 functions as a steam chamber with jets of steam being suitably introduced into the void in the top of each container immediately before the closure is applied both for a sterilizing effect and also for a vacuum packing. This introduction of steam is in a conventional manner. There is also connected to the right hand end of the housing 116 a vacuum line 236 which, as is best shown in FIG. 2, is connected to a vacuum pump 237 driven by a motor 238.

Figure 15:
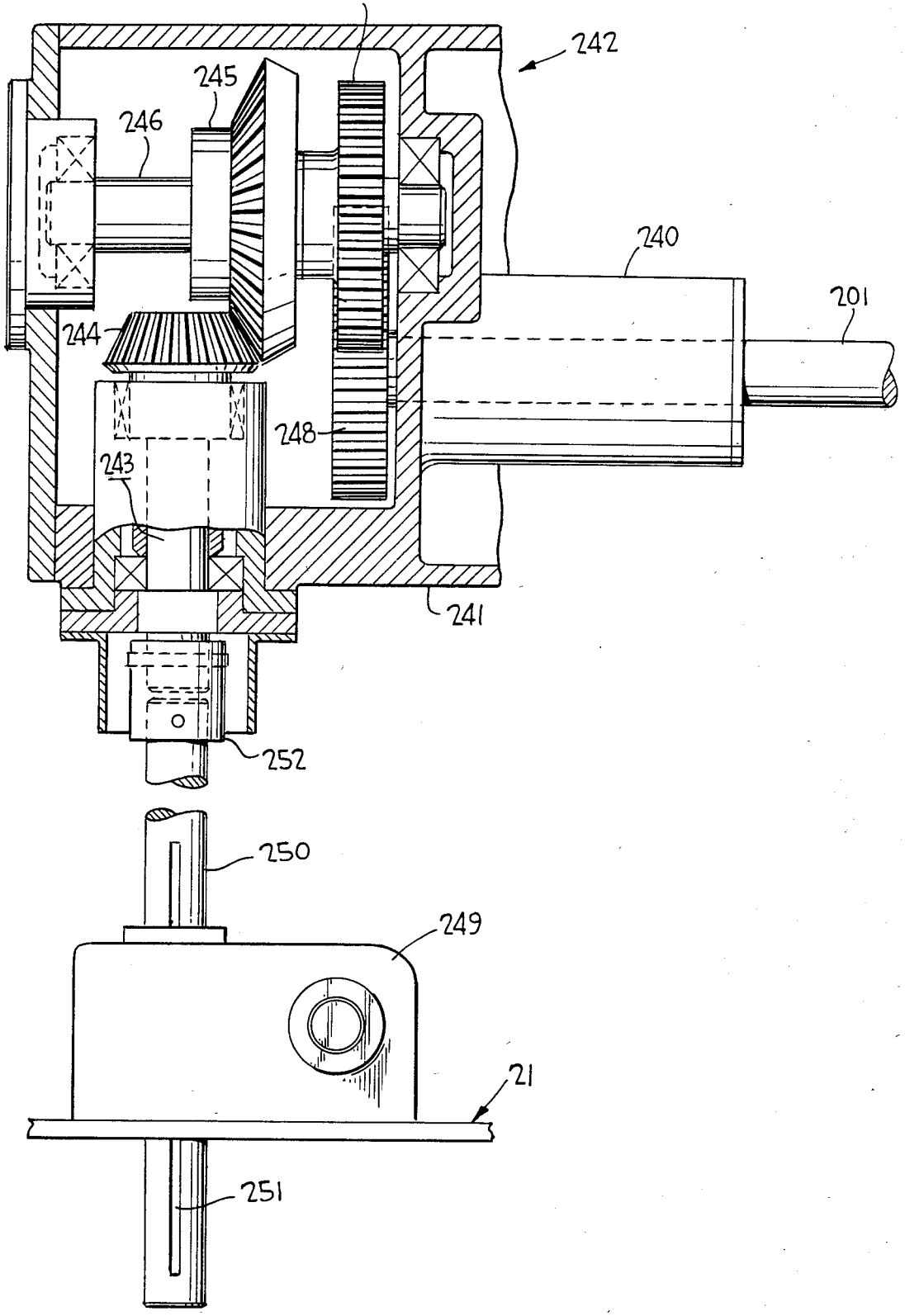
FIG. 15 is an enlarged elevational view with parts broken away, showing the manner in which the cap rotating belts are driven from the drive motor.

Referring now to FIG. 15, it will be seen that the shaft 201 is supported by an elongated bearing unit 240 of a housing 241 of a gear box 242. The gear box housing 242 is fixedly secured to the housing 116 with the shaft 201 projecting into the housing 116 for receiving the pulleys 202, 203.

The gear box 242 has an input shaft 243 which is provided at its upper end with a bevelled gear 244 which is meshed with a bevelled gear 245 carried by a transverse shaft 246. The shaft 246 also carries a pinion gear 247 which is meshed with a pinion gear 248 carried by the shaft 201.

There is carried by the base 21 a lower gear box 249 having an internally keyed tubular shaft (not shown) through which an elongated vertical shaft 250 extends. The shaft 250 carries an elongated key 251 for keying interlock with the unillustrated tubular shaft. The upper end of the shaft 251 is connected to the shaft 243 by a coupling 252.

As is shown in FIG. 1, there is mounted at one side of the base 21 a single drive motor 253 for the entire universal capper 20. The drive motor 253 has a shaft 254 on which there is mounted a variable diameter pulley 255. The pulley 255 drives a pulley 256 through a belt 257 with the pulley 256 being carried by an input shaft 258 of the gear box 249. The gear box 249 also has a second takeoff shaft 260 which carries a pulley 261 which drives through a belt 262 a pulley 263 of a jack shaft 264. The jack shaft 264 has an output pulley 265 which, through a belt 266, drives a pulley 267 carried by an input shaft 268 of the gear box 33.

It is to be understood that all of the gear boxes have gearing to provide the desired ratio of drives to the respective elements.

The overall speed of the machine is controlled solely by varying the diameters of the pulley 255. As is best shown in FIG. 4, the pulley 255 is of a conventional variable diameter type having an adjusting nut and shaft assembly including a nut 269 and a shaft 270. The nut 269 is held in place by an arm 271 slidable on a rod 272. The shaft 270 has a universal drive coupling 273 to a control rod 274 which extends transversely through the machine for adjustment by the machine operator from the opposite side of the machine. It is to be understood that the machine speed may be adjusted while the machine is in operation.

It will be obvious from the foregoing that the universal capper 20, for all practical purposes, is fully adjustable so that the capper may be converted from one size container to another with practically no shut-down time. Further, since the speed of operation of the machine is adjustable, the universal capper may have its speed readily adjusted so as to accommodate different size containers and thus vary the speed of movement of the containers in accordance with that allowable for the respective container size.

It is also to be understood that by having all of the drives of the machine such that height and transverse adjustments may be actuated during the operation of the universal capper, a maximum efficiency of the machine may be readily obtained.

Although only a preferred embodiment of the universal capper has been specifically illustrated and described herein, it is to be understood that minor variations may be made without departing from the spirit and scope of the invention as defined by the appended claims.

We claim:

1. A universal capper for applying caps to containers, said capper comprising a base, an endless conveyor carried by said base and having a container supporting run at a fixed elevation, a first support, first mounting means mounting said first support for vertical adjustment relative to said base, container retaining belt means carried by said first support on opposite sides of a longitudinal center line of container passage through said machine, a capper head, second mounting means mounting said capper head for vertical movement relative to said base, a second support, mounting means mounting said second support on said capper head for vertical adjustment both with and with respect to said capper head, closure rotating belts carried by said second support on opposite sides of said center line, a third support carried by said capper head for vertical adjustment therewith relative to said base, closure guide chute elements carried by said third support on opposite sides of said center line, and adjusting means for separately adjusting the spacing of said container retaining belts, said closure guide chute elements and pressure areas of said closure rotating belts and for separately vertically adjusting the height of said first, second and third supports and said capper head while said capper is operating, said first mounting means including four rectangularly arranged column type supports between said base and said first support, a threaded shaft and nut arrangement within each column type support between said base and said first support, and drive means connected to said threaded shaft and nut arrangement for actuating the same in unison to vertically adjust the elevation of said first support and thus said container retaining belts while said capper is in operation, each of said container retaining belts having a drive including a rotatable drive element fixed relative to said first support for rotation, said container retaining belts having opposed runs for engaging containers, and adjustable belt positioning shoes engaging said container retaining belts and determining the transverse positions of said opposed runs to accommodate containers of different diameters.

2. A universal capper according to claim 1 wherein each of said container retaining belts has slack take-up means coupled to the respective belt positioning shoe for automatically changing the position of said slack take-up means upon adjustment of the belt positioning shoe.

3. A universal capper according to claim 1 wherein there is a single drive motor for said endless conveyor, said container retaining belts and said closure rotating belts, together with means for adjusting the drive ratio from said motor to said conveyor and said belts during the operation of said capper.

4. A universal capper for applying caps to containers, said capper comprising a base, an endless conveyor carried by said base and having a container supporting run at a fixed elevation, a first support, first mounting means mounting said first support for vertical adjustment relative to said base, container retaining belt means carried by said first support on opposite sides of a longitudinal center line of container passage through said machine, a capper head, second mounting means mounting said capper head for vertical movement relative to said base, a second support, mounting means mounting said second support on said capper head for vertical adjustment both with and with respect to said capper head, closure rotating belts carried by said second support on opposite sides of said center line, a third support carried by said capper head for vertical adjustment therewith relative to said base, closure guide chute elements carried by said third support on opposite sides of said center line, and adjusting means for separately adjusting the spacing of said container retaining belts, said closure guide chute elements and pressure areas of said closure rotating belts and for separately vertically adjusting the height of said first, second and third supports and said capper head while said capper is operating, said first mounting means including four rectangularly arranged column type supports between said base and said first support, a threaded shaft and nut arrangement within each column type support between said base and said first support, and drive means connected to said threaded shaft and nut arrangement for actuating the same in unison to vertically adjust the elevation of said first support and thus said container retaining belts while said capper is in operation, each of said container retaining belts having a drive including a rotatable drive element fixed relative to said first support for rotation, said container retaining belts having opposed runs for engaging containers, and adjustable belt positioning shoes engaging said container retaining belts and determining the transverse positions of said opposed runs to accommodate containers of different diameters.

* * * * *